US006655328B2

(12) United States Patent
Kather

(10) Patent No.: US 6,655,328 B2
(45) Date of Patent: Dec. 2, 2003

(54) METHOD FOR CONTROLLING AN ELECTROMAGNETIC VALVE DRIVE BY CHANGING THE CURRENT DIRECTION WHEN SUPPLYING THE ELECTROMAGNETS WITH CURRENT

(75) Inventor: Lutz Kather, Würselen (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 10/254,917

(22) Filed: Sep. 26, 2002

(65) Prior Publication Data

US 2003/0066500 A1 Apr. 10, 2003

(30) Foreign Application Priority Data

Sep. 29, 2001 (DE) ..... 101 48 403

(51) Int. Cl.[7] ..... F01L 9/04

(52) U.S. Cl. ..... 123/90.11; 123/90.15; 251/129.01

(58) Field of Search ..... 123/90.1, 90.11, 123/90.15; 251/129.01, 129.02, 129.15, 129.16, 129.18

(56) References Cited

U.S. PATENT DOCUMENTS 4,491,113 A * 1/1985 Gassler et al. ..... 123/490
5,647,321 A * 7/1997 Ichikawa et al. ..... 123/399
6,276,318 B1 * 8/2001 Yanai et al. ..... 123/90.11
6,494,172 B2 * 12/2002 Komatsu et al. ..... 123/90.11
6,549,390 B1 * 4/2003 Ozawa et al. ..... 361/139

* cited by examiner

*Primary Examiner*—Thomas Denion
*Assistant Examiner*—Ching Chang
(74) *Attorney, Agent, or Firm*—Venable LLP; Norman N. Kunitz

(57) ABSTRACT

A method for controlling an electromagnetic actuator for actuating a cylinder valve (6) in a piston-type internal-combustion engine, with the valve having two electromagnets (1, 2) that are spaced from one another, and an armature (5) that is connected to the cylinder valve (6) to be actuated and is guided back and forth, counter to the force of a restoring spring (7, 8), between the facing magnet pole faces of the electromagnets, and with the coils (10, 11) of the electromagnets alternately being acted upon with a direct current via a control device (9) at predetermined intervals. When the piston-type internal-combustion engine is operated under a higher load, the flow direction of the current through the coils (10, 11) of the two electromagnets (1, 2) is preset by the control device (9) so that the magnetic flux (arrows 14, 15) alternately effected in the armature (5) by the two coils (10, 11) remains unidirectional. For low-load operation (idling mode) of the engine, the magnetic flux is altered by the repolarization of the flow direction of the current through one of the coils (10, 11), so that the magnetic flux effected in the armature (5) alternately flows in opposite directions (arrows 14.1, 15.1) when the coils are supplied with current.

1 Claim, 4 Drawing Sheets

METHOD FOR CONTROLLING AN ELECTROMAGNETIC VALVE DRIVE BY CHANGING THE CURRENT DIRECTION WHEN SUPPLYING THE ELECTROMAGNETS WITH CURRENT

CROSS-REFERENCE TO RELATED APPLICATION

This application is based on and claims the priority date of German Application No. 101 48 403.8, filed on Sep. 29, 2001, which is incorporated herein by reference.

BACKGROUND OF THE INVENTION

Electromagnetic valve drives for actuating the cylinder valves in a piston-type internal-combustion engine essentially comprise two electromagnets, which are spaced from one another, and an armature, which is connected to the cylinder valve to be actuated and is guided back and forth, counter to the force of restoring springs, between the magnet pole faces that face one another. The coils of the electromagnets are alternately acted upon with a current via a control device at predeterminable intervals, corresponding to the operating data of the piston-type internal-combustion engine, primarily the rpm and, accordingly, the work cycle. After the current is cut off, the force of a restoring spring moves the armature resting against the pole face of one electromagnet in the direction of the pole face of the other electromagnet. As the armature approaches, the respective other magnet is acted upon by a (high) capturing current, so the armature comes to rest against its pole face due to the capturing magnetic field, and counter to the force of a restoring spring associated with the capturing electromagnet. With a corresponding control of the current supply, the high capturing current can be reduced to a retaining current immediately before or upon the impact of the armature against the pole face, so the affected cylinder valve can accordingly be held in the open or closed position with a low current consumption.

The armature should impact the pole face of the respective capturing magnet at the lowest possible speed to avoid bouncing. Thus, the kinetic energy inherent to the armature is of great significance in the equilibrium phase preset by the opposing restoring springs. Because the spring energy of the tensed restoring spring that acts on the armature is practically constant at the respective retaining magnet, it is only possible to influence the maximum kinetic energy during the armature's passage through the equilibrium position by altering the current supply to the capturing or the retaining magnet.

At the capturing electromagnet, the current supply is controlled such that the armature moves in a linear ramp or slope for the last tenths of a millimeter prior to impacting the pole face. For this purpose, it is necessary that the armature not swing through, i.e., have an excessively high kinetic energy, during this final approach phase. With a high engine load, this is attained through a "consumption" of kinetic energy due to the counterpressure in the cylinder combustion chamber, which supports the current control. With a low load, however, especially in idling operation, the effect of the counterpressure is so weak that practically no "braking" effect, that is, no "consumption" of kinetic energy, occurs.

In the past, to achieve a braking effect with a low-load, a braking current pulse was applied to the retaining electromagnet immediately following the cutoff of current when the armature began to move. Consequently, a magnetic force that counteracted the force of the restoring spring briefly acted on the armature, thus "sapping" a corresponding quantity of kinetic energy at the start of the armature movement.

Controlling idling operation with a braking current pulse also has its drawbacks. In particular, the capturing current at the capturing magnet and the braking current at the releasing magnet overlap, the valve flight time is increased, and the maximum speed is lower during the passage through the equilibrium position. To compensate for this, the spring-mass oscillator comprising the armature, cylinder valve and restoring springs would have to be faster, i.e., stronger restoring springs would have to be used. A further drawback, which is specific to a rapid change in load, for example, from idling in the direction of full-load operation, is that the control device would already have to decide prior to the armature movement whether the braking current pulse should be activated. This precludes the option of utilizing sensor information about the actual armature movement, which can be obtained with modern sensor equipment.

SUMMARY OF THE INVENTION

It is the object of the invention to provide a method that can avoid an operating mode requiring braking current pulses.

According to the invention, the above object generally is achieved by a method for controlling an electromagnetic actuator for actuating a cylinder valve in a piston-type internal-combustion engine, with the valve having two electromagnets that are spaced from one another, and an armature that is connected to the cylinder valve to be actuated and is guided back and forth, counter to the force of at least one restoring spring, between facing magnet pole faces of the two electromagnets, and a control device for controlling the current supplied to the coils of the electromagnets. This method comprises: using the control device, alternately supplying the coils of the electromagnets with a direct current at predetermined intervals; determining whether the piston-type internal-combustion engine is operated under a high load or under low-load operation (idling mode); and, controlling the flow direction of the current through the coils of the two electromagnets so that (a) for high-load operation, the magnetic flux alternately effected in the armature by the respective currents in the two coils is unidirectional, and (b) for low-load operation (idling mode), the magnetic flux alternately effected in the armature by the respective currents in the two coils flows in opposite directions due to repolarization of the flow direction of the current through one of the two coils.

The advantage of the invention is that, when the piston-type internal-combustion engine is operating under a high load, the control device presets the flow direction of the current through the coils of the two electromagnets such that the magnetic flux in the armature, which is effected alternately by the two coils, remains unidirectional. This eliminates a remagnetization, so the residual magnetism remaining in the still-moving armature after the retaining current has been cut off prevents magnetic hysteresis losses. The armature, and thus the cylinder valve to be actuated, are moved back and forth without a time delay, which assures reliable operation, even with a large load, and especially at high rpms.

For low-load operation, particularly for idling operation, the polarity of the current of one coil is reversed, which changes the flow direction of the current through the coil for the duration of this load, so that the magnetic flux effected or produced in the armature alternately flows in opposite directions when the coil of the respective capturing magnet is supplied with current. In other words, the armature is alternately remagnetized. As a consequence of this remagnetization, when the current increases, the introduced electrical energy is not converted into kinetic energy of the armature, but into magnetic hysteresis losses and, finally, thermal losses. A positive effect of this former practice of "falsely" polarizing the coils of an electromagnetic valve drive is that, in idling operation, less kinetic energy can be coupled in without costly switching and control measures, and without adversely affecting the armature flight time. For both full-load and idling operation, the current can be set at a high level. Nevertheless, for idling operation, only a reduced quantity of kinetic energy is supplied to the armature, because a portion of the electrically fed-in energy is expended through magnetic hysteresis losses. When the operating mode is switched from idling to a higher load, it is only necessary to reverse the polarity of the current in order to introduce the electrical energy into the system with a high efficiency.

In comparison to solutions in which the current is set at the desired level for supplying the kinetic energy required by the armature for the respective load, the method of the invention is less costly. Particularly in comparison to control systems having a boost voltage or a generally high voltage level, the method of the invention requires a lower outlay for components.

The invention is described in detail by way of schematic drawings.

DESCRIPTION OF THE PREFERRED EMBODIMENTS

Figure 1:
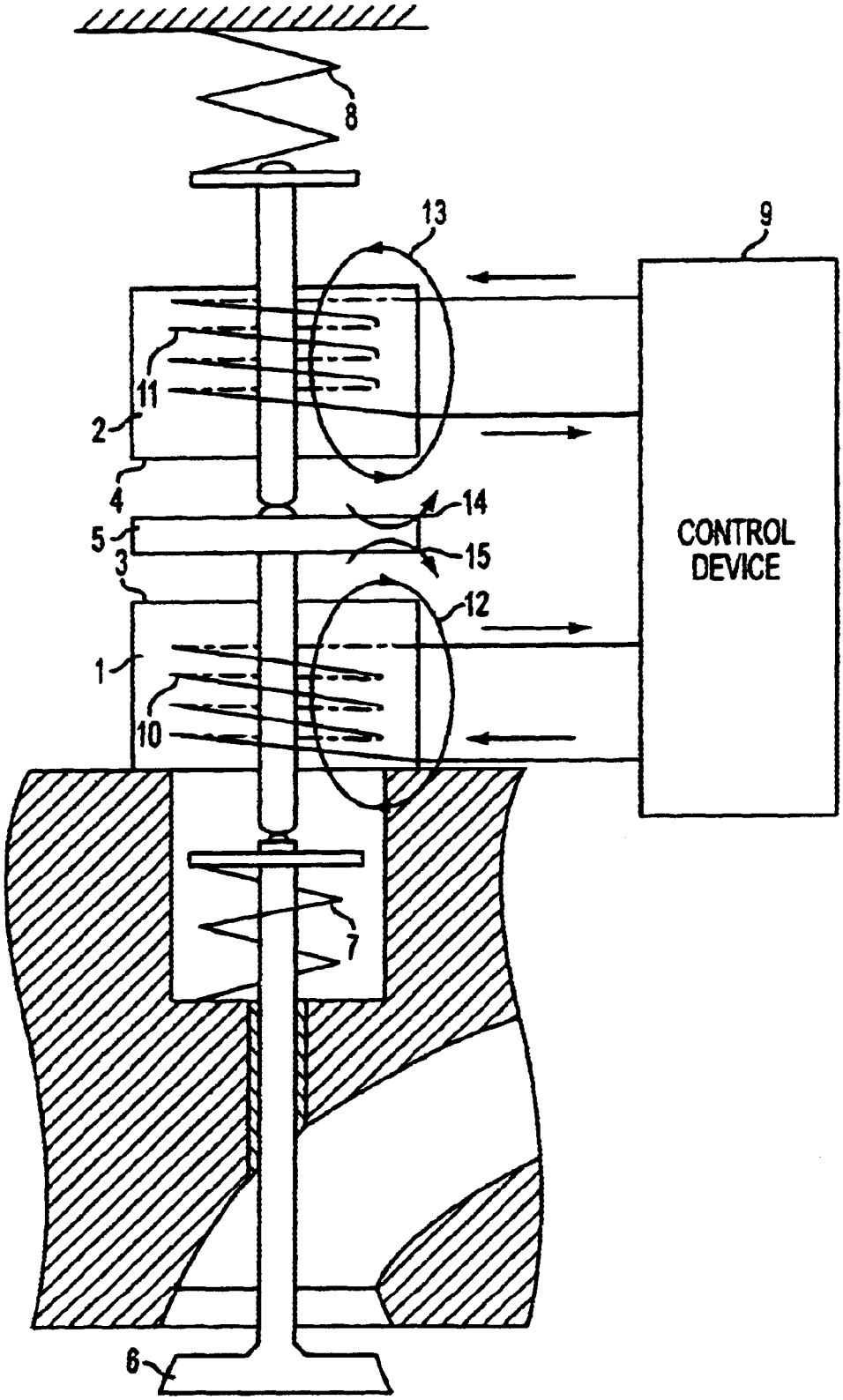
FIG. 1 is a schematic representation of an electromagnetic valve drive having a unidirectional magnetic flux through the armature.

The electromagnetic valve drive illustrated in FIG. 1 essentially comprises two electromagnets 1 and 2, whose respective pole faces 3 and 4 are spaced from and face one another. An armature 5 is moved back and forth between the pole faces 3 and 4. The armature 5 is in an operative connection with a cylinder valve 6.

In the illustrated position, the two electromagnets 1 and 2 are currentless, so the armature 5 is in the equilibrium position that is established by the two restoring springs 7 and 8, and corresponds to the center position between the two pole faces 3, 4.

When the electromagnet 1 serving as the opening magnet is supplied with current, the armature 5 is drawn to the pole face 3 and the cylinder valve 6 is shifted into its open position. The restoring spring 7 is compressed in the process.

When the opening magnet 1 is currentless, the effect of the prestressed restoring spring 7 accelerates the armature 5 in the direction of the electromagnet 2 serving as the closing magnet. This magnet 2 is supplied with current for a period when the armature 5 passes through the region of the center position, so the force of the magnetic field of the closing magnet 2 brings the armature to rest against the pole face 4, counter to the increasing force of the restoring spring 8.

The electromagnets 1 and 2 are supplied with current as follows: In the movement phase of the armature 5 toward a pole face, a high capturing current is applied to the associated magnet 1 or 2, and is maintained at a constant level immediately prior to the impact of the armature against the associated pole face. Afterward, the current is reduced to a low retaining current, which is generally cycled between an upper and a lower current value for keeping the armature against the pole face with the lowest possible power or energy consumption, until a control device 9 cuts off the current supply to the retaining magnet, e.g., the magnet 1, and the capturing magnet, e.g., the magnet 2, is acted upon by a capturing current when the armature passes through the center position.

Because the force of the respective restoring spring 7 or 8 increases in a linear fashion as the armature 5 approaches the pole face, but the force of the magnetic field, in contrast, increases progressively as the air gap between the pole face and the armature decreases, the control device 9 controls the current supply such that the armature impacts the pole face with the lowest possible impact speed in order to avoid bouncing or the like. Various methods are known for controlling the current in electromagnetic valve drives to effect a "gentle" impact of the armature against the pole face of the respective capturing electromagnet.

Because it is necessary for the armature to move at high speed between the currentless retaining magnet and the capturing magnet supplied with current during full-load operation, but especially during high-rpm operation, the coils 10 and 11 of the opening magnet 1 and the closing magnet 2, respectively, having windings in the same direction, are supplied with current such that the magnetic flux through the armature 5 remains unidirectional in the armature 5, whether under the effect of the opening magnet or the closing magnet, as shown. In other words, no high-loss magnetization occurs that would reduce the energy supply. The orientation of the two magnetic fields 12 and 13 at the two electromagnets 1 and 2 is correspondingly indicated. The magnetic flux through the armature 5 is correspondingly represented by the two unidirectional arrows 14, 15.

At a higher engine load, losses due to the counterpressure in the cylinder combustion chamber effect a desired braking of the movable mass comprising the armature 5 and the cylinder valve 6, which is mode-dependent to a certain extent. In the above-described current regulation, no energy is extracted from the system because of the low-loss energy conversion, due to the absence of remagnetization of the armature 5.

The desired energy losses effected by the counterpressure in the cylinder combustion chamber are, however, not present in idling operation of an engine, so the current regulation must be changed especially for idling operation.

It has been seen that a repolarization of the flow direction of the current through the coils 10 or 11 of the opening or closing magnet, as effected by the control device 9, can attain a loss effect, even for idling operation, without an intervention into the current regulation. In the same way, less energy is supplied to the system during the armature movement after the retaining phase has ended, and thus, a regulation permits a gentle impact.

Figure 2:
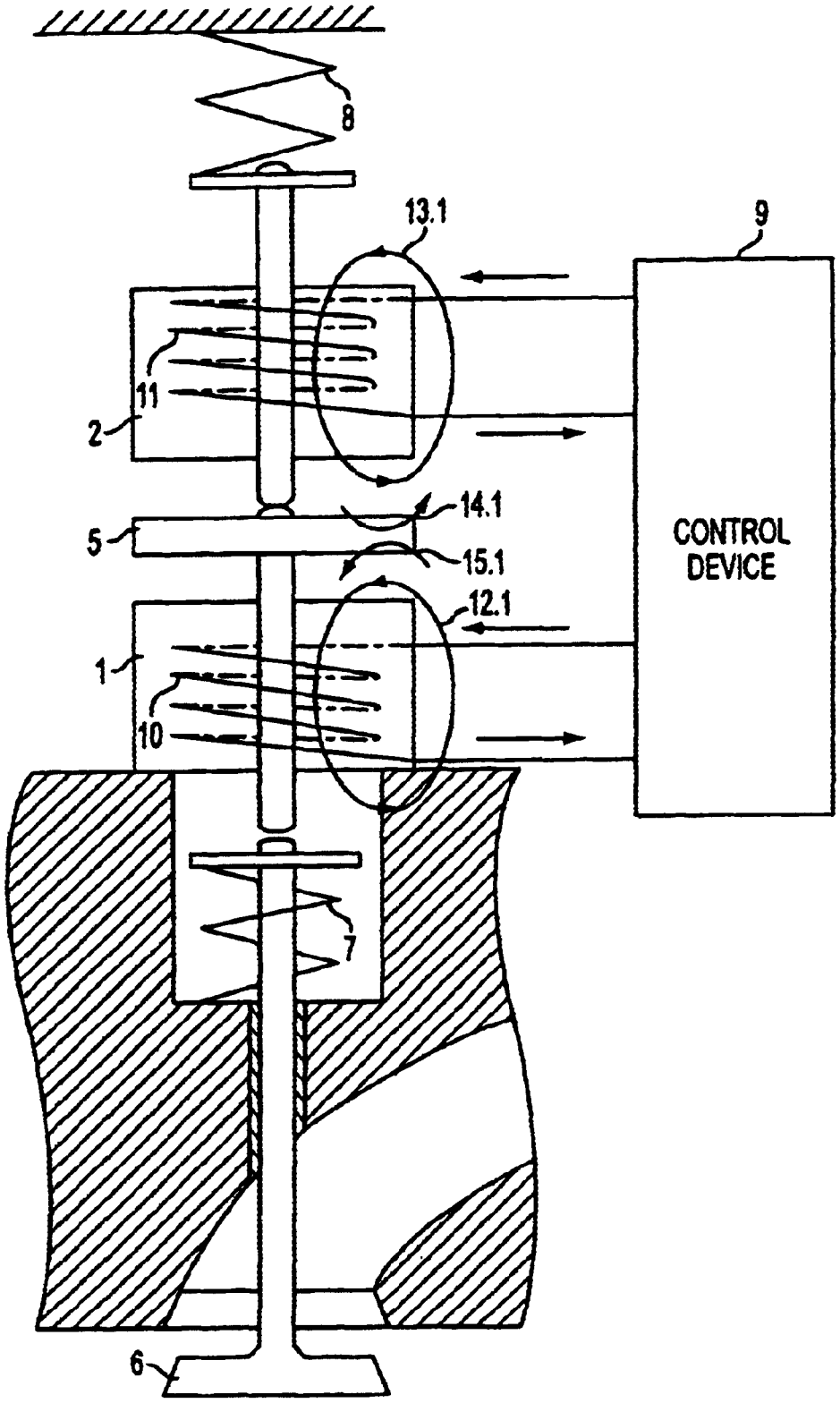
FIG. 2 shows the valve drive according to FIG. 1, with the armature being re-magnetized according to the invention.

As shown for the embodiment illustrated in FIG. 2, the control device 9 alters the current supply to the coil 10 of the opening magnet 1 with regard to the current flow direction for idling operation, in comparison to normal operation, through a repolarization. In a coil arrangement in which the windings of the two coils of the two electromagnets 1 and 2 are in the same direction, as in the illustrated embodiment, current flows through both coils in the same direction, so the magnetic fields 12.1 and 13.1 of the coils 10 and 11 cause the magnetic flux effected in the armature 5 to flow in respective opposite directions, as indicated by the arrows 14.1, 15.1, and contrary to the orientation direction of FIG. 1.

The resulting remagnetization of the armature 5 causes the electrical energy that has been fed in when the current is increased in the capturing electromagnet not to be converted into kinetic energy of the armature, but into remagnetization losses, and ultimately, into thermal losses. Although the current in the electromagnet is set at a high level, a larger portion of the supplied electrical energy is converted into thermal losses, so less mechanical energy is supplied to the armature and therefore to the mass system during the movement phase. In idling operation, similarly to the gas-pressure losses at a higher load, this energy results in a gentle impact of the armature against the pole face of the respective capturing electromagnet.

In the illustrated embodiment, the coils 10, 11 of the opening magnet 1 and the retaining magnet 2 are wound in the same direction relative to one another, so for the "higher load" operating mode described by FIG. 1, the flow direction of the current through the two coils is oriented in opposite direction, whereas in "idling" operation, the flow direction is oriented in the same direction in both coils.

If the coils are wound oppositely relative to one another, the flow direction of the current must accordingly also be different, i.e., in the same direction for the "higher load" mode and in the opposite direction for the "idling" mode.

Figure 3:
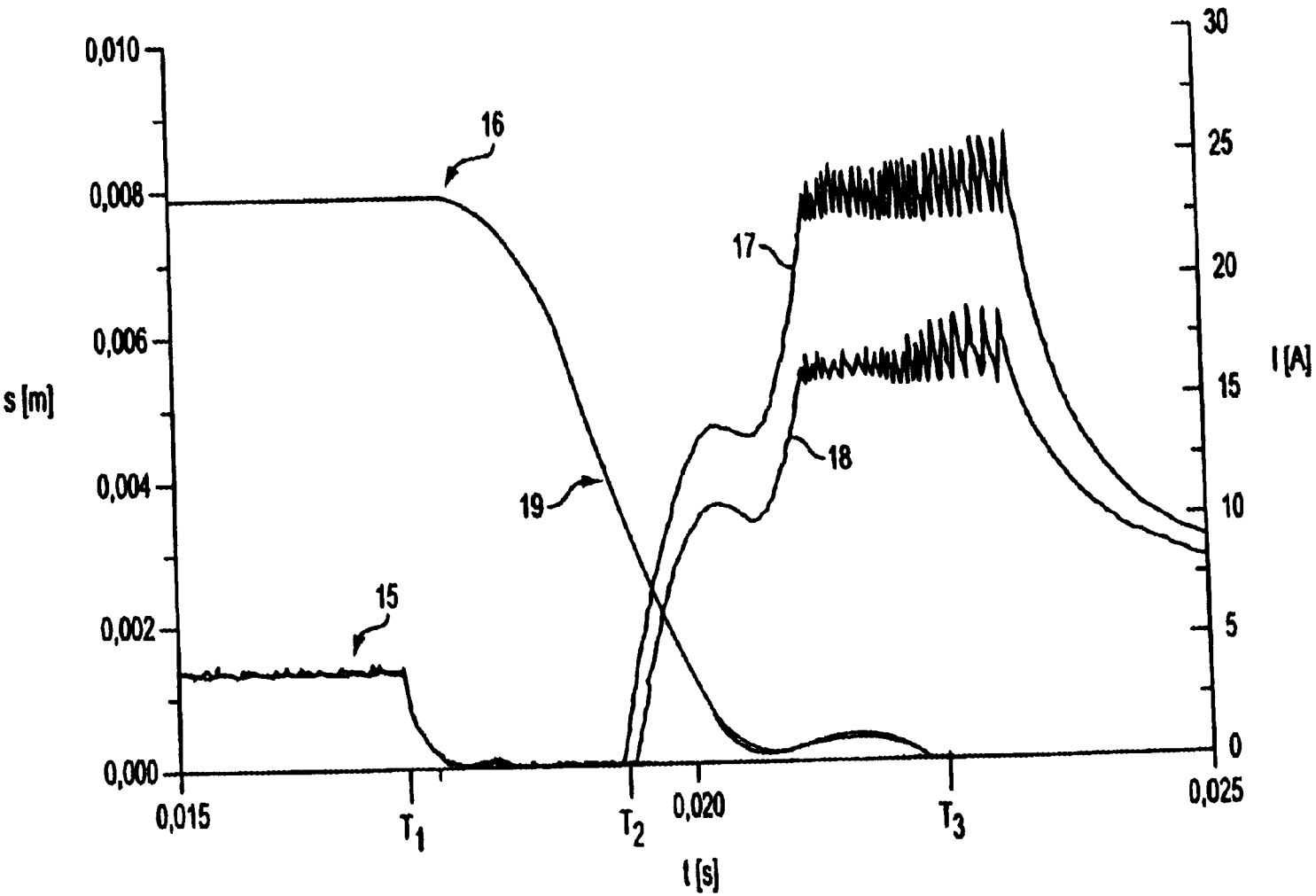
FIG. 3 shows the armature path over time, as a function of the current.

In FIG. 3, two practically coinciding curves 16 represent the path of the armature 5 from its initial position at the pole face of a retaining magnet in the direction of the pole face of a capturing magnet for the two "polarization cases," each in idling mode without a load.

The line 15 indicates the curve of the retaining current at the retaining magnet. The line 18 represents the curve of the capturing current at a capturing magnet, with a polarization of the current to both magnets corresponding to FIG. 1.

The line 17 indicates the curve of the capturing current at a capturing magnet, with a polarization corresponding to FIG. 2.

If, at a time $T_1$, the low retaining current at the retaining magnet is cut off, the armature 5 releases from the pole face of the retaining magnet after a so-called "sticking time," as indicated by the line 16, and moves in the direction of the pole face of the capturing magnet, which is defined by the abscissa. At about the time $T_2$, i.e., when the armature passes through the center position (Point 19 on the path curve), the capturing current is activated at the capturing magnet.

The current curve according to the line 17 and the current curve indicated by the line 18 show that the current level is somewhat reduced in the form of an OPEN LOOP, that is, without intervention by a regulating system, immediately before the armature impacts the pole face of the capturing magnet. Subsequently, however, the current level is raised again to overcome the losses in the approach region.

Shortly after the armature impacts the pole face at the time $T_3$, the high capturing current is reduced to the level of the retaining current indicated by the curve 15.

Whereas the operating mode according to FIG. 1 involves a high capturing current, in the operating mode according to FIG. 2, significantly less energy is supplied to the armature, despite an introduction of a higher current into the system due to the remagnetization, so the path curve of the armature for the operating mode according to FIG. 2 practically coincides with the path curve of the armature for the operating mode according to FIG. 1.

This positive effect on the movement path of the armature is achieved without controlling the current flow to the coils of the respective retaining magnet, but merely through a simple repolarization of the flow direction of the current through the coils.

Whereas the previous end stage for an actuator functionally comprised two half-bridges that had at least two transistors and two diodes, in practice such end stages were formed with three transistors and one diode, accordingly only one further transistor is required. The provision of a further transistor forms a full bridge from the half-bridge, which makes available expanded functionality with corresponding actuation logistics, that is, it permits a bidirectional current feed.

It suffices for one of the two half-bridges to be expanded to a full bridge. This means that the outlay per actuator is only one further transistor with an actuating mechanism. As a countermeasure, one power diode is omitted, so the space requirement for the power semiconductors on the board is the same as in the prior art.

Figure 4A:
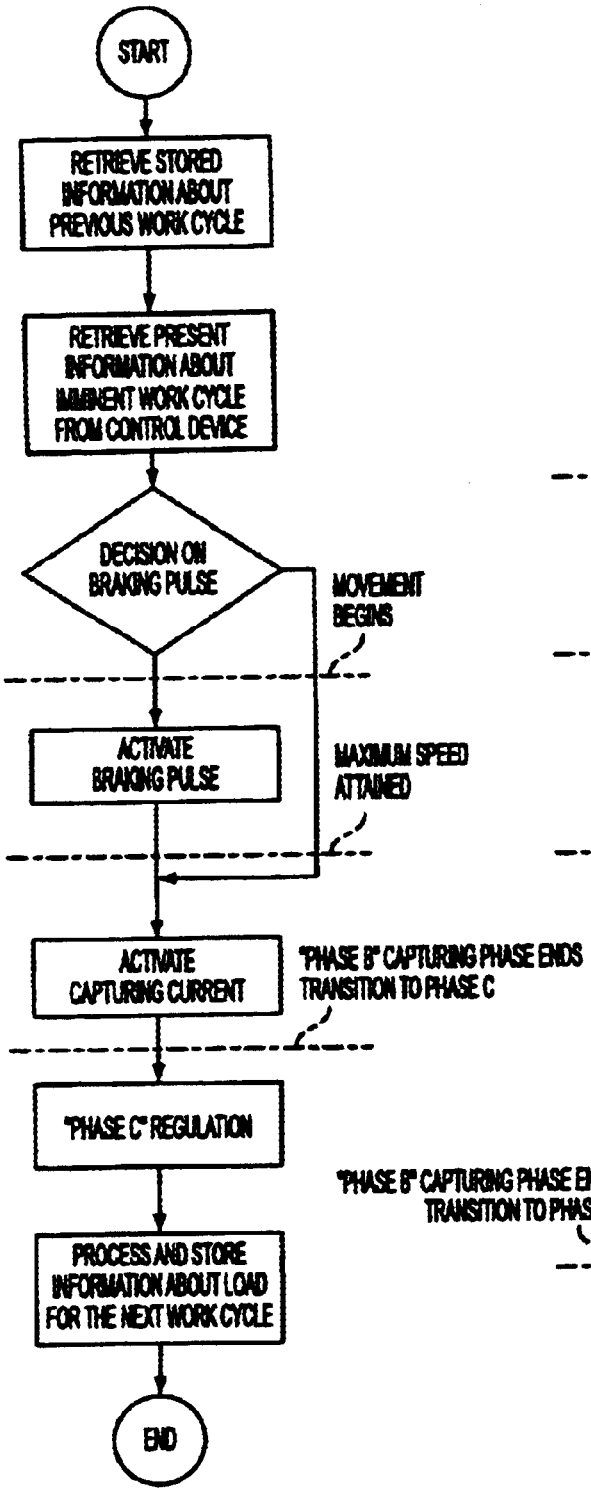
FIG. 4A PRIOR ART
FIGS. 4*a* and 4*b* respectively show, for comparison purposes, a timing diagram according to the prior art and a diagram of the control device according to the invention.

The diagram of FIG. 4*a* is a flow chart of the actuation of the electromagnets in conventional form, that is, without the repolarization of the current direction.

Figure 4B:
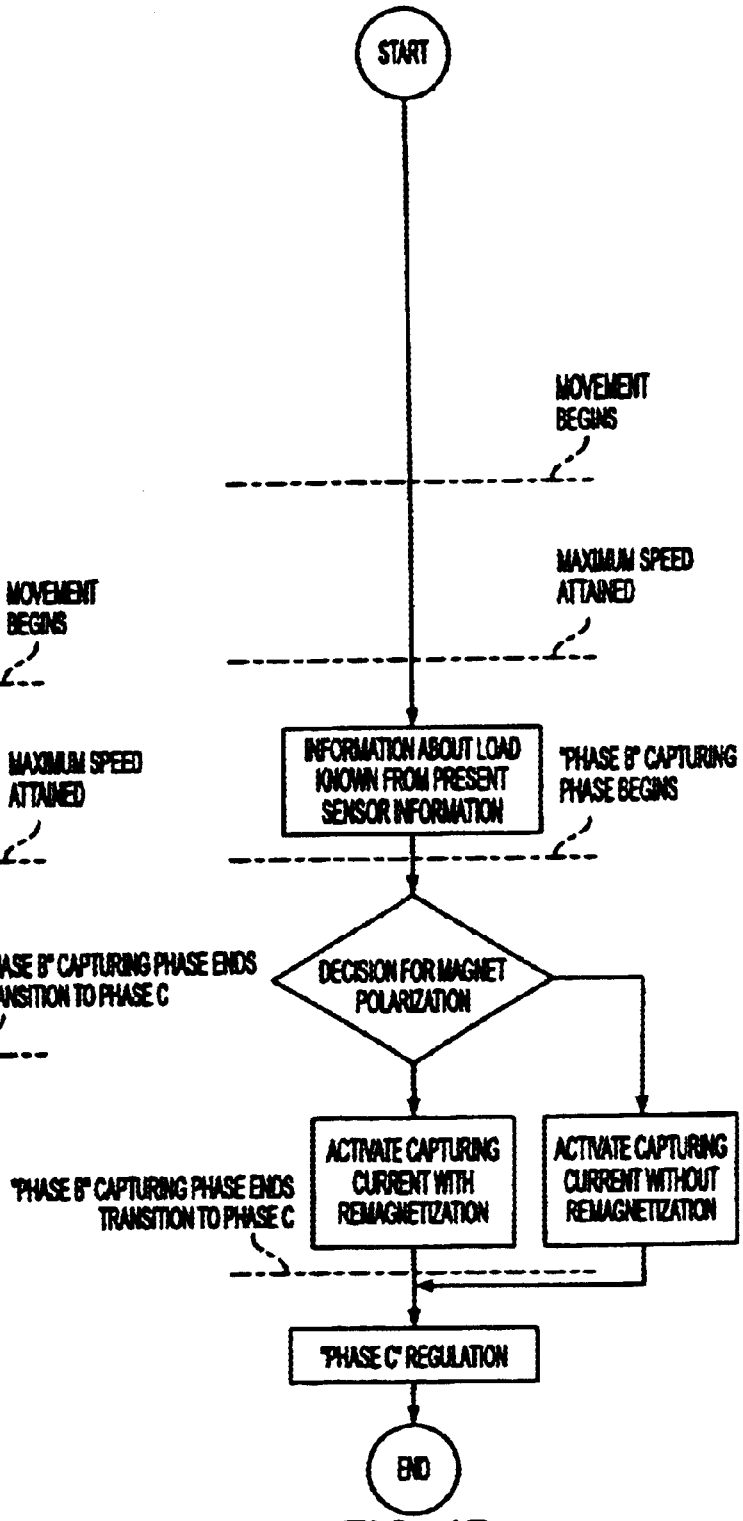
FIG. 4B PRIOR ART

In comparison, FIG. 4*b* is the flow chart and therefore the control process for the method according to the invention.

In the diagram according to FIG. 4*a*, the stored information pertaining to the previous operating cycle and the present information pertaining to the imminent operating cycle must be retrieved from the control device 9 at the start, and accordingly, it must be decided whether a brake pulse should be initiated for the given operating mode, which must then be activated. Contrary to this, the method according to the invention, as shown in FIG. 4*b*, permits information relating to the load to be retrieved from the present sensor information. Therefore, it can be determined immediately whether the piston-type internal-combustion engine is being operated in an idling mode, which means that the capturing current must be switched for a remagnetization, or the engine is operating with a load, so no repolarization and therefore no remagnetization is to be effected. Not until this point in time are the regulation measures identical again in both methods.

In the known method, however, information pertaining to the load for the next operating cycle must be stored simultaneously in the regulation phase; this is not necessary in the method according to the invention.

The invention now being fully described, it will be apparent to one of ordinary skill in the art that many changes and modifications can be made thereto without departing from the spirit or scope of the invention as set forth herein.

What is claimed is:

1. A method for controlling an electromagnetic actuator for actuating a cylinder valve in a piston-type internal-combustion engine, with the valve having two electromagnets that are spaced from one another, and an armature that is connected to the cylinder valve to be actuated and is guided back and forth, counter to the force of at least one restoring spring, between facing magnet pole faces of the two electromagnets, and a control device for controlling the current supplied to the coils of the electromagnets; said method comprising: via the control device alternately supplying the coils of the electromagnets with a direct current at predetermined intervals;

determining whether the piston-type internal-combustion engine is operated under a high load or under low-load operation; and, controlling the flow direction of the current through the coils of the two electromagnets so that (a) for high-load operation, the magnetic flux alternately effected in the armature by the respective currents in the two coils is unidirectional, and (b) for low-load operation (idling mode), the magnetic flux alternately effected in the armature by the respective currents in the two coils flows in opposite directions due to repolarization of the flow direction of the current through one of the two coils.

* * * * *